US006957827B2

(12) United States Patent
Kogler

(10) Patent No.: US 6,957,827 B2
(45) Date of Patent: Oct. 25, 2005

(54) DEVICE FOR CONNECTING A SPORTS BOOT WITH A SLIDING MEANS

(75) Inventor: Hannes Kogler, Vöcklabruck (AT)

(73) Assignee: Fischer Gesselschaft m.b.H., Ried Im Innkreis (AT)

( * ) Notice: Subject to any disclaimer, the term of this patent is extended or adjusted under 35 U.S.C. 154(b) by 0 days.

(21) Appl. No.: 10/683,556

(22) Filed: Oct. 10, 2003

(65) Prior Publication Data

US 2004/0140647 A1 Jul. 22, 2004

Related U.S. Application Data

(63) Continuation of application No. PCT/AT02/00109, filed on Apr. 11, 2002.

(30) Foreign Application Priority Data

Apr. 11, 2001 (AT) ..... A 584/2001

(51) Int. Cl.[7] ..... A63C 9/00
(52) U.S. Cl. ..... 280/613; 280/623
(58) Field of Search ..... 280/611, 613, 615, 280/617, 623, 625, 634

(56) References Cited

U.S. PATENT DOCUMENTS

| | | | | |
|---|---|---|---|---|
| 3,724,866 A | * | 4/1973 | Kaplan | 280/607 |
| 3,810,643 A | * | 5/1974 | Druss | 280/613 |
| 3,905,613 A | * | 9/1975 | Romeo | 280/623 |
| 4,021,056 A | * | 5/1977 | Oakes | 280/613 |
| 4,348,036 A | * | 9/1982 | Settembre | 280/615 |
| 4,361,344 A | * | 11/1982 | Hull et al. | 280/613 |
| 4,836,572 A | * | 6/1989 | Pozzobon | 280/613 |
| 5,087,065 A | | 2/1992 | Provence et al. | |
| 5,697,631 A | | 12/1997 | Ratzek et al. | |
| 6,209,904 B1 | | 4/2001 | Schnitzhofer | |
| 6,276,708 B1 | * | 8/2001 | Hogstedt | 280/613 |

FOREIGN PATENT DOCUMENTS

| | | | | |
|---|---|---|---|---|
| DE | 2 225 564 | * | 2/1973 | 280/613 |
| DE | 27 06 111 | | 8/1978 | |
| FR | 2 537 445 | * | 6/1984 | 280/615 |
| SE | 113 817 | * | 4/1945 | 280/615 |
| WO | WO 84 00498 A | | 2/1984 | |
| WO | WO 9741931 A | | 11/1997 | |

* cited by examiner

*Primary Examiner*—Frank Vanaman
(74) *Attorney, Agent, or Firm*—Martin Fleit; Paul D. Bianco; Fleit, Kain, Gibbons, Gutman, Bongini & Bianco P.L.

(57) ABSTRACT

A ski binding for cross-country skis and touring skis with a step-in mechanism. The ski binding has two pressure-spring-loaded retention bolts located in the toe region and extending substantially transversely to the running direction and having a rounding at their outer ends. The retention bolts engage in openings of the boot sole or of parts of the latter and can be brought out of the snapped-in position by a releasing mechanism, wherein the rounding of the retention bolt is to lie above that plane which extends through the longitudinal axis of the bolt and in the snapped-in state, parallel to the ski upper side.

10 Claims, 12 Drawing Sheets

DEVICE FOR CONNECTING A SPORTS BOOT WITH A SLIDING MEANS

RELATED APPLICATION

This application is a Continuation Application of International Application No. PCT/AT02/00109, filed Apr. 11, 2002, the contents of which are herein incorporated by reference.

BACKGROUND OF INVENTION

1. Field of Invention

The invention relates to a device for connecting a sports boot with a sliding means, in particular a ski binding for cross-country skis and touring skis, with a step-in mechanism.

2. Prior Art

Cross-country ski bindings presently on the market are characterized by axes of rotation located at the tip of the boot or slightly behind the tip of the boot. This results in an unnatural rolling-off movement over the tilting edge forming under the tip of the boot, requiring the use of more strength and possibly causing pain in the toe region (also "bruised toes") in addition.

Moreover, these systems are characterized in that the axis provided in the boot is clamped by the ski binding by means of a type of toggle lever between two metal shells. Particularly in the rolling-off position, if transverse forces occur, this connection is not rigidly positively locked, which results in a yielding of the system and thus in a reduced controllability of the ski.

In the embodiment as an automatic binding, this disadvantage is even more evident, since the pressure springs used there in general can apply less closing forces than the toggle lever mechanism used in manual systems.

A further disadvantage of presently used bindings consists in that the bolt which is cast into the boot is anchored transversely to the groove extending in the boot sole, whereby cleaning of the latter if it is filled with dirt or ice is rendered more difficult.

Finally, a ski binding destined for ski-touring has become known from DE 3 141 425, in which latching bolts shiftable transversely to the longitudinal direction of the ski engage in lateral recesses of the boot sole in the tip region thereof. In this ski binding, the free ends of the latching bolts are designed according to a rotationally symmetrical curve so as to allow for an easy overcoming of forces in all directions relative to the corresponding bore. Thus, this binding is designed as a safety binding. The known safety bindings of the described type are not suitable for Nordic sports, in particular for top-level sports.

SUMMARY OF INVENTION

The invention has as its object to provide a binding which is also suitable for Nordic sports, in particular the top-level sports.

This object is achieved by the measures according to the invention as described herein.

BRIEF DESCRIPTION OF THE DRAWINGS

In the drawings, embodiments of the device according to the invention as cross-country ski binding are illustrated.

FIG. 3 shows a simplified side view of the ski boot;

FIG. 4 shows a rear view of the same;

DETAILED DESCRIPTION OF PREFERRED EMBODIMENTS OF THE INVENTION

Figure 1:
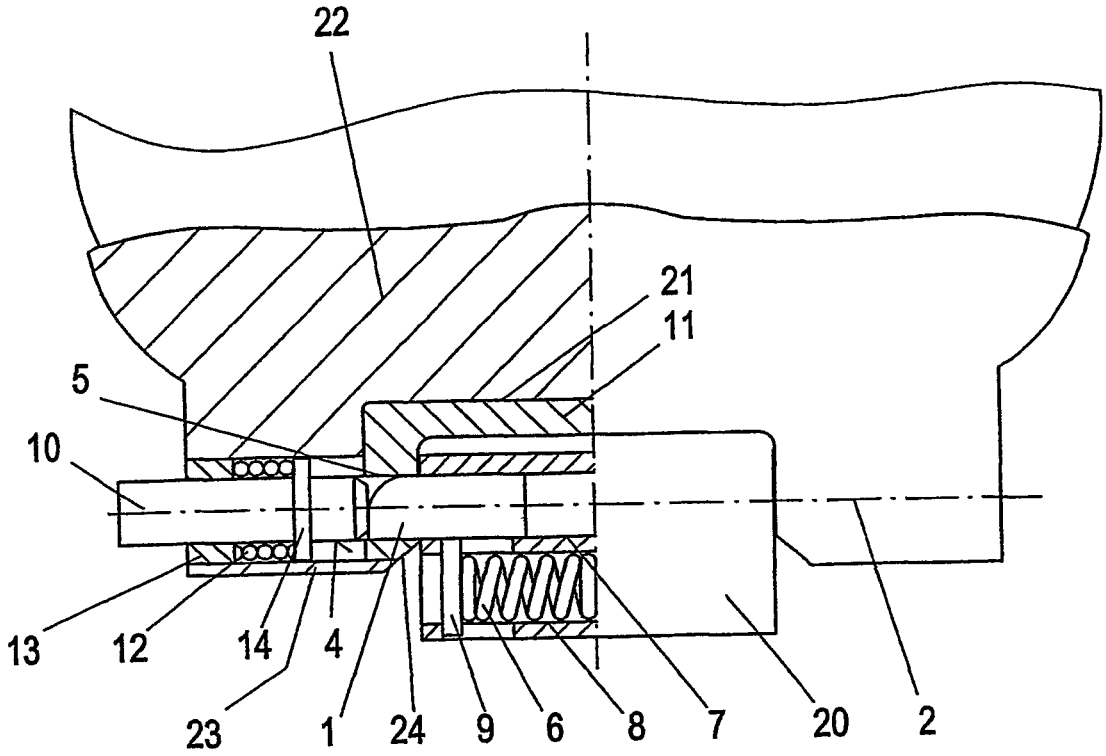
FIG. 1 shows a front view of the binding with the boot sole, partially sectioned.
Figure 2:
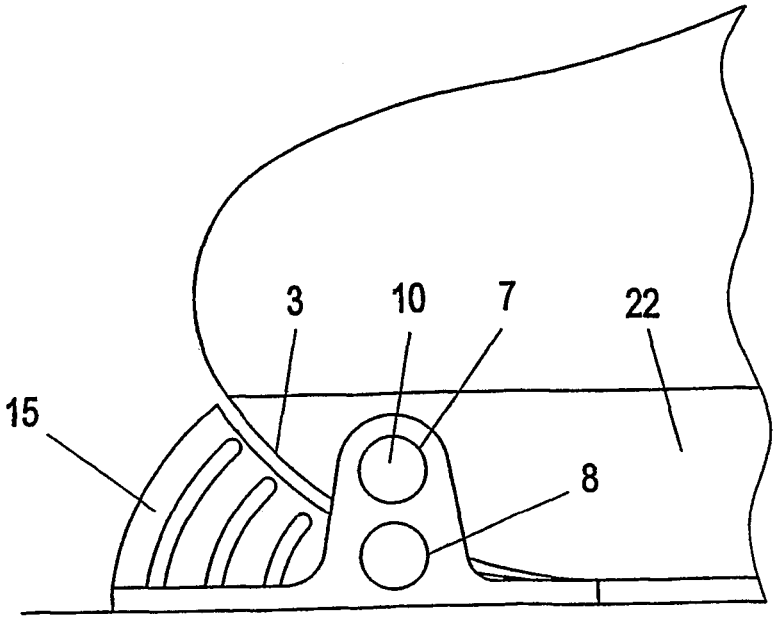
FIG. 2 shows a side view of the binding with the boot sole in the tip region.

In FIGS. 1 and 2, a pressure-spring loaded latching bolt of a step-in mechanism is denoted by 1, which is positioned approximately 1.5 cm behind the boot tip at the side of the binding.

One latching bolt 1 each is mounted in an end region each of a latching bolt bore 7, extending transversely to the running direction, of the binding 20 according to the invention, which binding is inserted in a U-shaped section 11 that is embedded in a corresponding recess 21 of the boot sole 22. The latching bolts 1 are provided with a rounding at their ends facing away from each other, which rounding is located above that plane which extends through the longitudinal axis of the bolt and, in the snapped-in state, parallel to the ski upper side. In this manner, stepping in from the top is ensured, and a clearance-free movement is possible, yet an uncontrolled opening of the binding is prevented.

The entry mechanism, which is designed as a step-in mechanism, is realized by pressure-spring loading of the latching bolts 1, which snap into oppositely arranged latching openings 4 in the boot sole 22 which also serve as a centering means. For this purpose, in the present case, the latching bolts 1 are provided with a universal ball joint-type rounding 5 which deviates the force from the perpendicular into the horizontal when the boot sole 22 snaps into the binding under the influence of the inclined outer walls 24 following upon and leading back to the latching opening 4.

By the precisely fitting adaptation of the two latching bolts 1 and the latching opening 4 in the boot sole 22, a clearance-free force transmission is obtained, enabling an ergonomic, strength-saving rolling off of the foot in the cross-country skiing technique. It can be sensed that lifting of the heel after the pressure application phase is effected much more homogeneous and smoothly. The introduction of force can be effected more precisely targeted for an effective push-off.

The afore-described positioning of the latching bolt 1 whose axis of rotation is denoted as 2, allows for a rounding 3 of the boot sole in the toe region (similar as it is in running shoes), thus facilitating walking (outside of the binding).

Moreover, by shifting the point of rotation, the distance of the boot (in the rolled-off state) from the ski is reduced, which in turn reduces occurring moments (transversely to the ski axis). This has a positive effect on the life of boot and binding, and also on the controllability of the ski in the swing phase.

Figure 3:
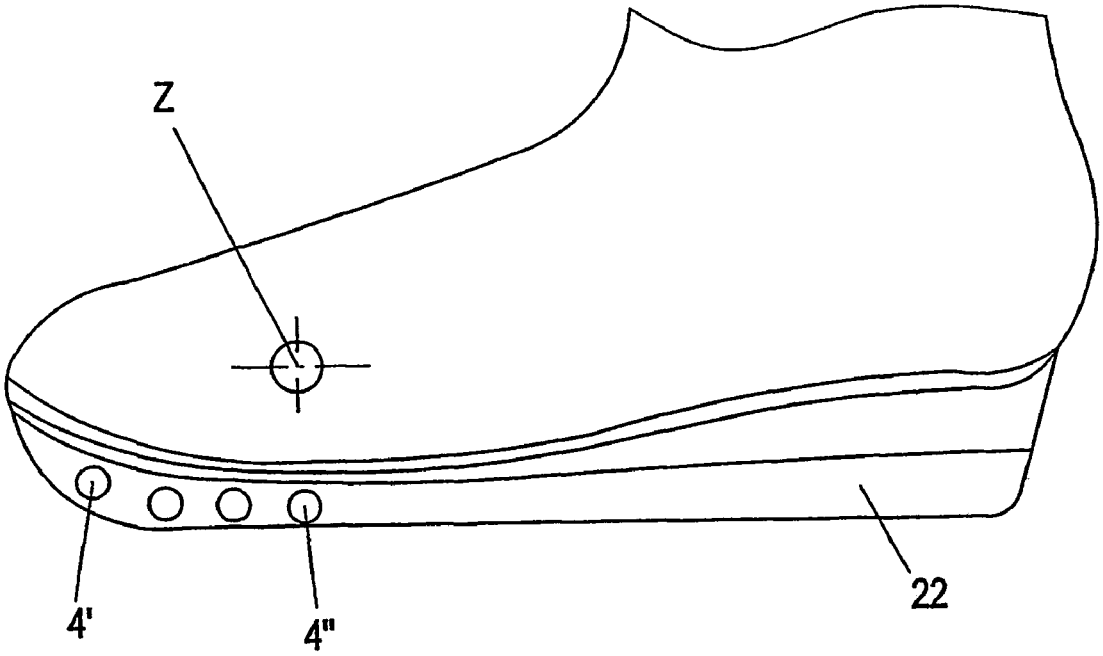
FIGS. 3 and 4 show detailed views of the recesses in the boot sole in side and front views.
Figure 4:
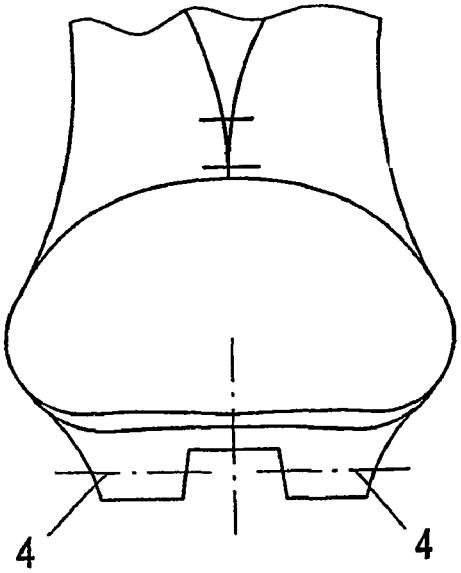

Advantageously, several adjacently arranged openings can be provided. Such an exemplary embodiment is shown in FIG. 3 in which latching openings 4 are provided, the metatarsophalangeal joint being denoted by Z. In this case, e.g. the latching opening 4' may serve for sportive cross-country skiing, and the latching opening 4" may serve for going downhill.

In the snapped-in state of the latching bolt 1 in boot sole 22, the entire outer surface of the latter will rest on the entire area of the guiding wall in the latching opening 4, whereby the afore-mentioned clearance-free force transmission will occur.

Below the bore 7 for guiding the latching bolts 1, or below the latching openings 4, respectively, there is a bore 8 provided in the binding 20 and extending transversely to the running direction and in parallel to the latching openings 4, said bore 8 being provided to guide a pressure spring 6 for the latching bolt 1. As force transmission elements and also as delimitation of the latching bolt movement, pins 9 perpendicularly pressed into the latching bolt 1 serve between which a compression spring 6 is installed.

By the positioning of the pressure spring 6 in a separate bore 8 below the latching bolt 1, the resilience for the functioning of the system can optimally be adjusted, since starting length and spring diameter are freely adaptable in certain ranges.

The release mechanism can be realized by two additional (less) spring-loaded bolts (called release bolts 10 hereinafter) in boot sole 22. The release bolts 10 are each pressed towards the center line of the boot sole 22 by means of pressure springs 12. The pressure springs 12 are each held in position by a ring 13 pressed into each of the two bores 23. A step 14 on the release bolt 10 prevents the escape of the latter towards the sole center. These release bolts 10, when not in their snapped-in position, close the latching openings 4 of the latching bolts 1 in the boot sole 22. By this, the latching openings are largely prevented from being soiled.

In the snapped-in position, the release bolts 10 are pressed outwards by the latching bolts in the direction laterally of the boot sole outer side so that an opening of the binding is easily feasible. For this purpose, the forefoot is surrounded with the palm, and the release bolts 10 are pushed in by means of thumb and, preferably, index finger. A slight lifting of the boot tip will suffice to enable stepping out of the binding.

The boot sole 22, preferably produced by injection moulding, is reinforced in the region of the release mechanism by means of an inserted section 11. The latter accommodates the forces occurring, and by the thus closed flow of force, the required strength of the boot sole is obtained.

In the described embodiment of the boot sole 22, stepping in will be possible also under difficult snow conditions without complex "clearing from snow".

To prevent forward tilting of the boot relative to the ski in the step position and to have a progressive force increase, a spring element, e.g. a rubber part or a damping element, respectively, may be present below the boot tip.

The damping element 15, preferably a cold-resistant elastomer, serves to pre-position the boot sole 22 when stepping into the binding. (Exact centering will be effected by the rounded latching bolt 1).

Furthermore, the damping element checks and delimits the rotational movement of the boot.

Various changes in the construction may, of course, be made within the scope of the invention. Thus, it is possible to design the binding 20 as an integral component of the ski, in particular of the cross-country ski.

Moreover, the latching bolts 1 and the release bolts 10 may be interchanged so that the latching bolts are externally located and the release bolts are inwardly located, in which case, however, also the pressure springs 6 and 12 would have to be interchanged so that the springs of the inwardly arranged, spring-loaded bolts are stronger than those of the spring-loaded, externally arranged bolts. In each case, the outwardly arranged bolt projecting outwards in the snapped-in position will be in contact with the inwardly arranged corresponding bolt.

If part 20 is designed as a binding, there exists the possibility that the section 11 serves as pivot part that is pivotable about the latching bolt 1 in the running direction.

Figure 5:
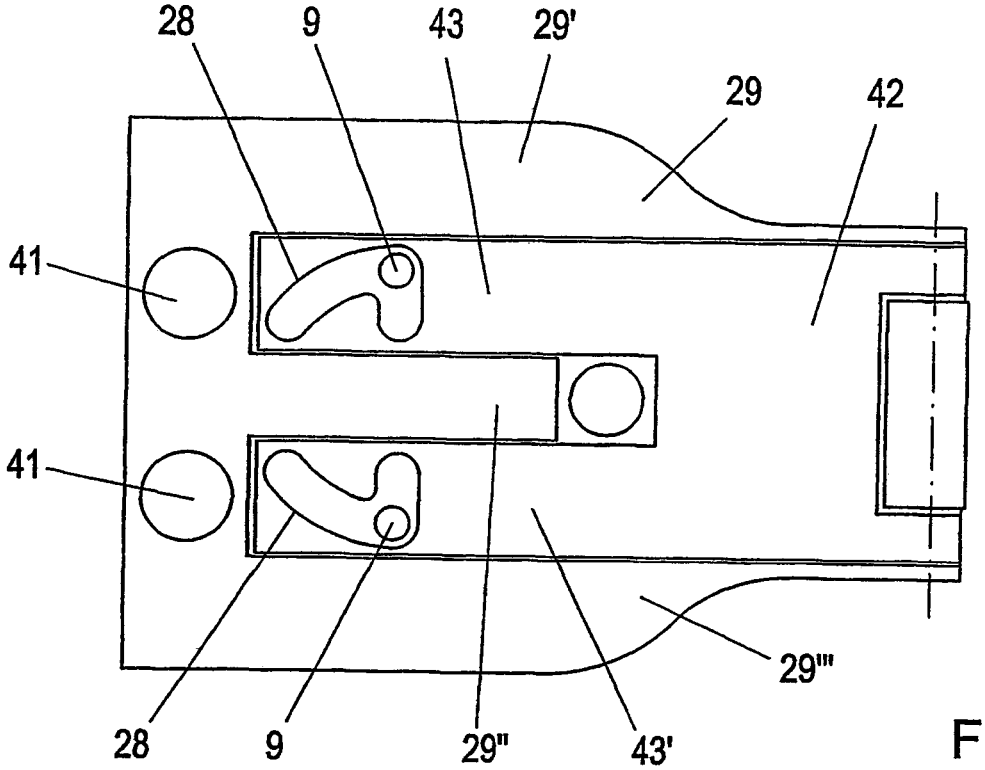
FIG. 5 shows a view of the ski binding from the bottom.

The embodiment of the cross-country ski binding according to FIGS. 5 to 9 has a base plate 29 to be fastened to the ski by means of screws, which base plate 29 has holes 41 for the fastening screws and which, as FIG. 5 shows, is configured fork-like with three prongs 29', 29" and 29"' and serves to accommodate the slide 42 which also is fork-shaped, yet only has two prongs 43, 43' which engage between the prongs 29', 29", and 29", 29"', respectively, of the base plate 29. The base plate 29 in its rear region is provided with a raised portion 45 extending transversely to the running direction, in which raised portion the two super-positioned channels or bores 7, 8, respectively, are provided, the bore 7 of which guides the two coaxially arranged latching bolts 1 which are under the influence of the pressure spring 6 guided in the bore 8 therebelow, which pressure spring 6 tends to press the latching bolts 1 apart so as to realize the effect of the step-in mechanism. In the present instance, the rounding 1', as is visible in FIG. 7, extends arcuately as far as to the lower generatrix 1" of the latching bolt 1. To transmit the force of the pressure spring 6 to the latching bolt 1, the pin 9 is pressed into each one of the former, the pressure spring 6 being tensioned between the two pins and tending to press the latching bolts 1 outwards from the bores 7. To control the movement of the latching bolts 1, the lower ends of the pins 9 are guided in links 28 which in the present case are recessed in the base plate 29 as angled, V-shaped slits facing each other by their openings. A slide 42 whose prongs 43', 43" flanking the middle prong 29" of the base plate 29 is pivotably connected via a hinge 30 with a lever 26 which is inclined towards the boot tip, the lever serving as actuating part for opening the binding and resting with a bead or knob or the like 40 on an inclined plane 27 and being provided with a hollow 106 for inserting the tip of the ski pole or the like, if the binding is to be opened.

By applying an opening force in the direction of arrow $F_1$, e.g. by means of the ski pole, the actuating part for such opening, in the present instance lever 26, will slide on the inclined plane 27 towards the ski surface, whereby the slide 42 will move forwards and thus the pins 9 are moved towards each other by means of the links 28, and the latching bolts 1 are released from the bores of the boot sole. In this instance, the force $F_1$ required for stepping in is progressive, i.e. the force for overcoming the static friction at first is slight and then increases.

When the boot steps into the binding, the slide 42 is not moved, only the latching bolts 1 are urged back by the inclination 1' against the force of the pressure spring 6, so that they emerge from the step-in openings of the boot sole.

Figure 8:
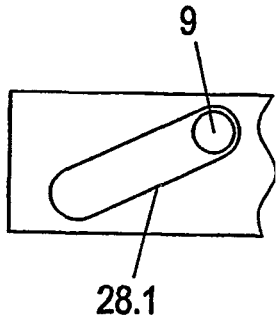
FIGS. 8 and 9 show details of the binding.

The release mechanism in FIG. 8 shows another possible way of shaping the link 28. In this instance, the link is designed as a straight, inclined slot.

The release mechanism is embedded in an elastomer part 15 and in this manner is protected against soiling, particularly against icing.

Within the scope of the invention it is, of course, possible to carry out various structural changes. Thus, release bolts could be provided in the boot sole which, when loaded by pressure springs, project outwards and rest on the inner end on the latching bolt 1, so as to close the bores which serve to accommodate the latching bolts, in use during walking, i.e. not in the mounted state on the ski so that they will be protected against the entry of ice, snow and dirt.

Also a locking means, e.g. by a socket or the like, may be installed which prevents an unintentional opening of the binding.

Figure 9:
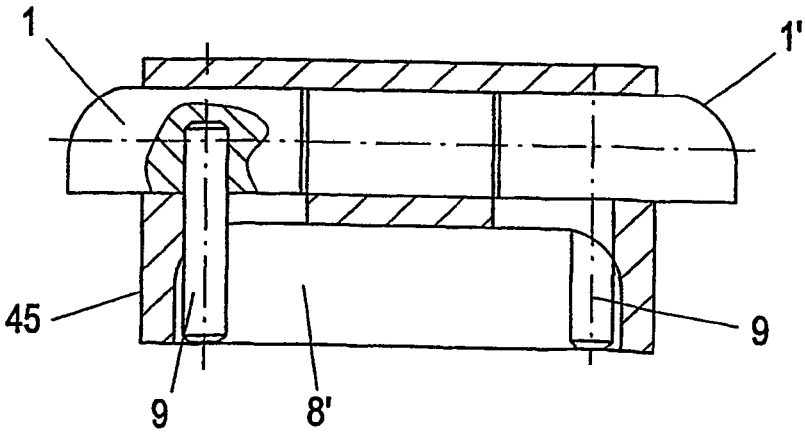
Figure 6:
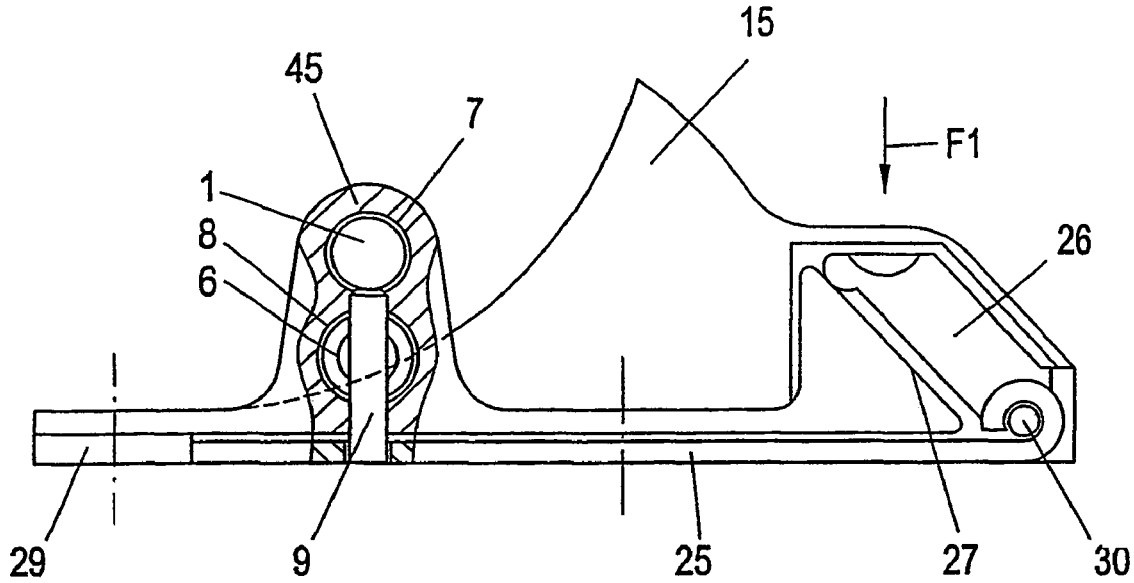
FIG. 6 shows a side view of the same.
Figure 7:
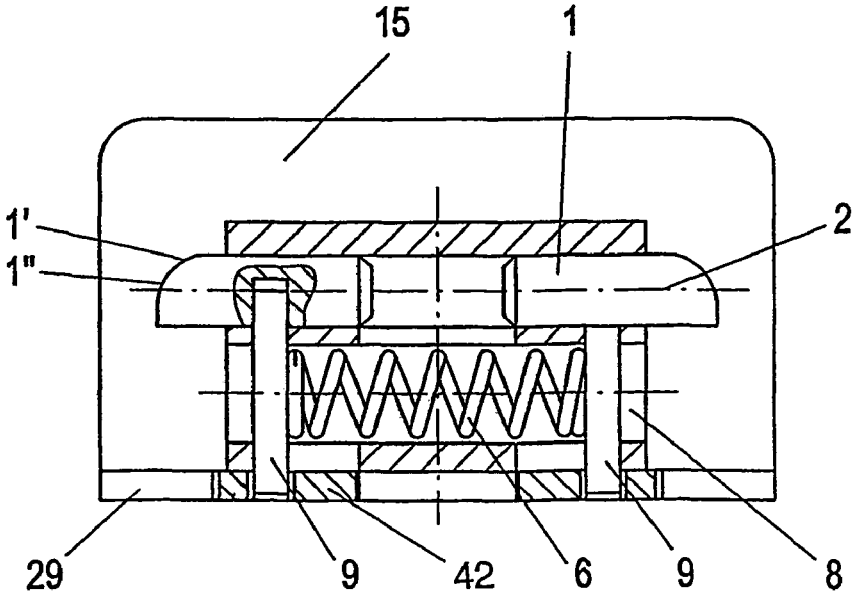
FIG. 7 shows a cross-section of the binding, perpendicular to the running direction.

As illustrated in FIG. 9, instead of the through-bore 8, a front end-side recess 8' may be formed in the raised portion 45 for the pressure spring 6 by milling or the like.

Advantageously, the end-side roundings of the latching bolts 1 preferably extend as far as to one third of the projecting bolt length at the most, whereby the advantage is obtained that an unintentional release of the binding is prevented. It is also possible to design such a rounding as an inclined face, as is visible in FIG. 9. Finally, it is possible to make the end of the latching bolt slanting instead of rounding it, and to replace the roundings in the claimed manner by a plane, inclined face.

In the embodiment of the cross-country ski binding according to FIGS. 10 to 17, a binding housing is provided which has an outer housing part 100 provided with openings 103 on either side so as to accommodate the latching bolts 101 of the step-in mechanism.

Figure 11:
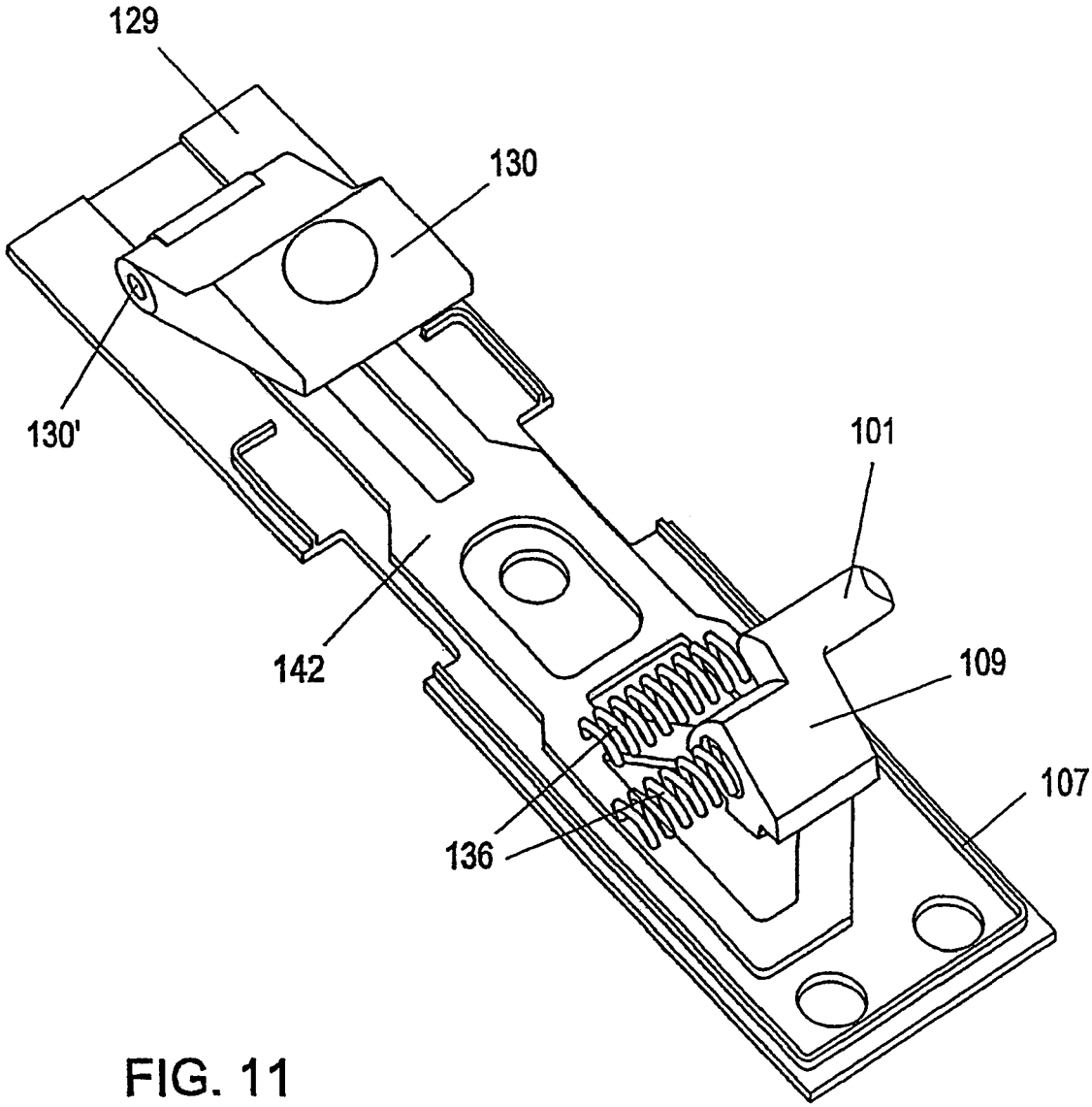
FIG. 11 shows a lid with the slide of the opening mechanism.
Figure 12:
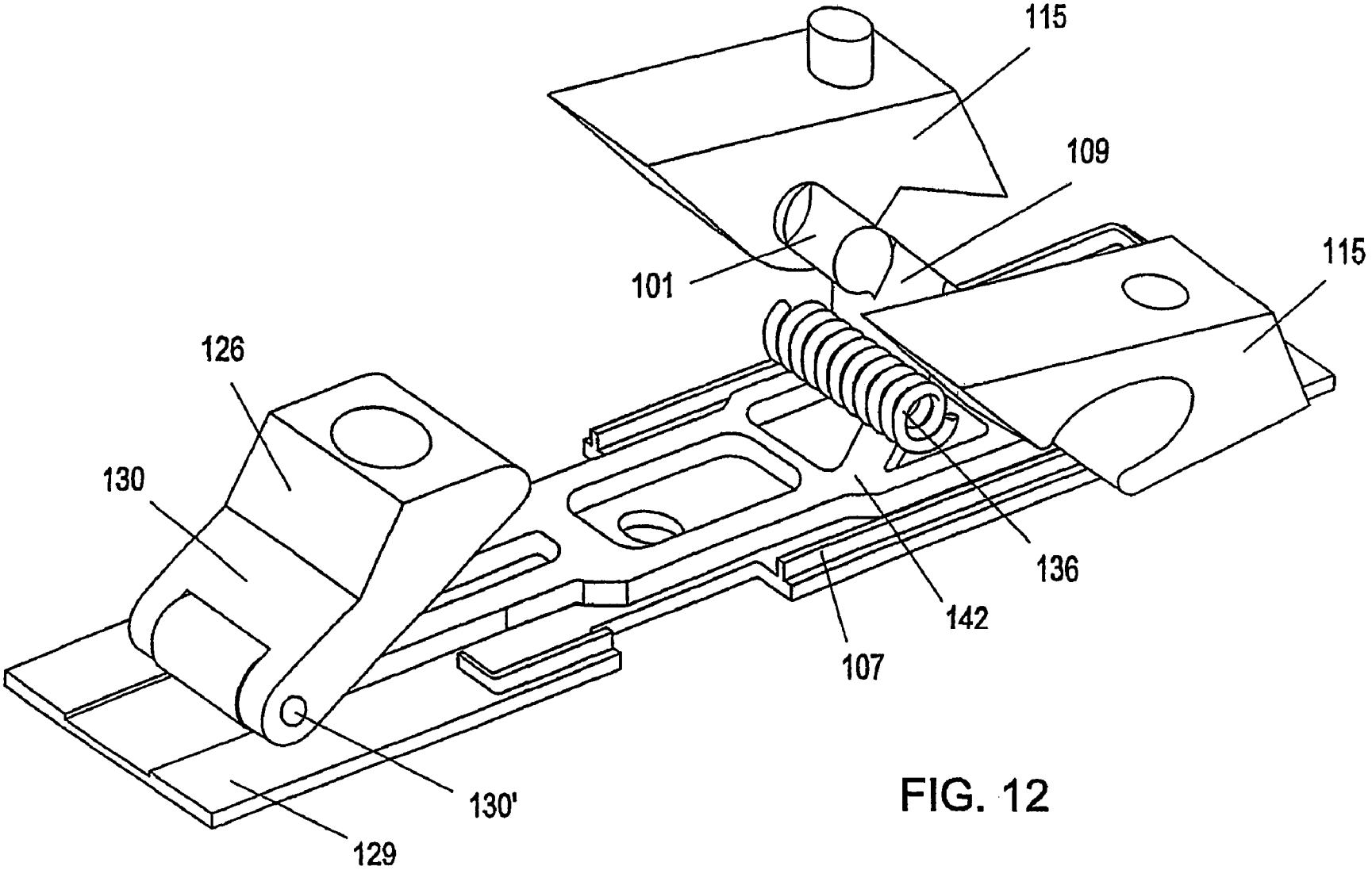
FIG. 12 shows the opening mechanism.
Figure 14:
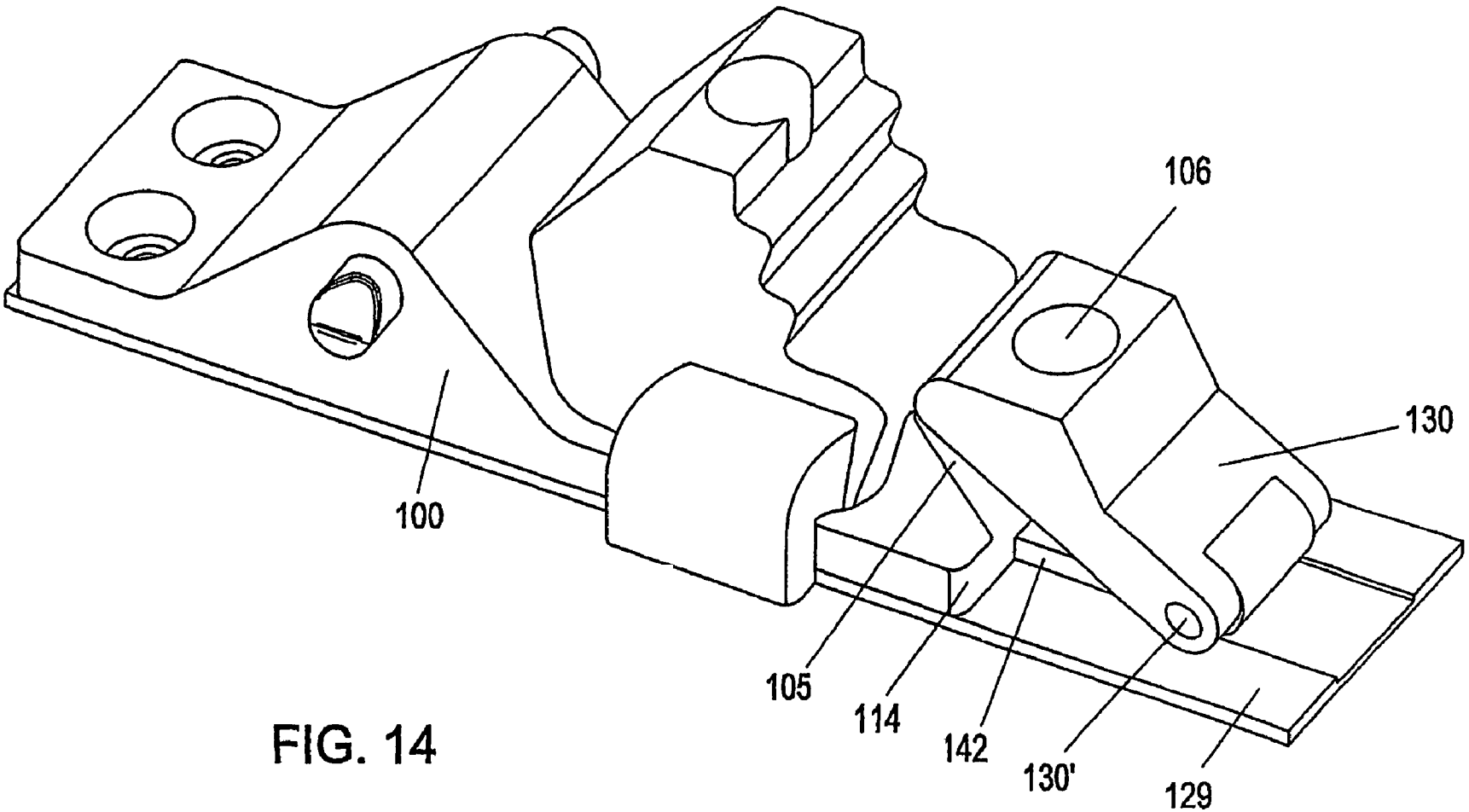
FIG. 14 is a perspective view of the binding.
Figure 15:
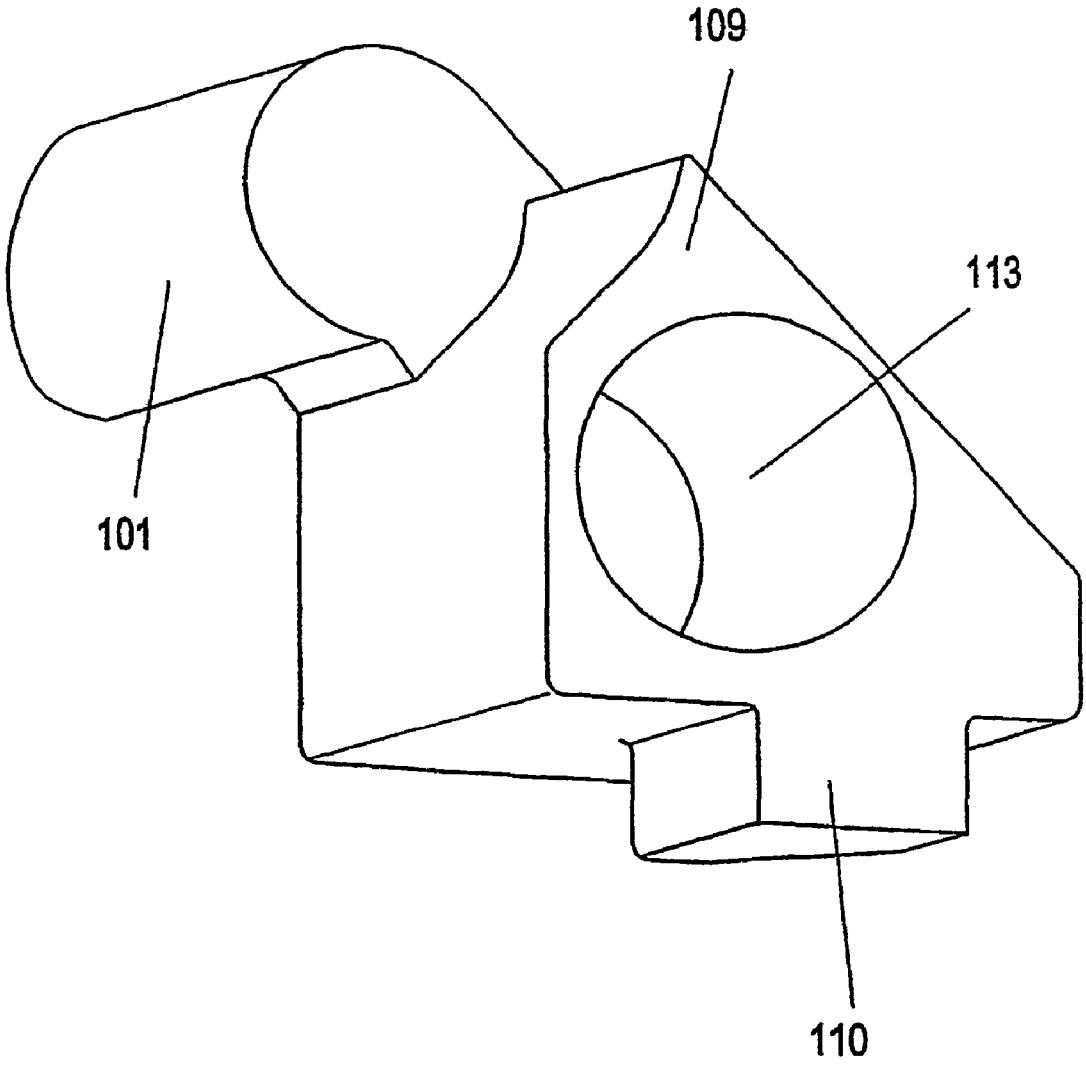
FIG. 15 shows a further detail of the binding.
Figure 16:
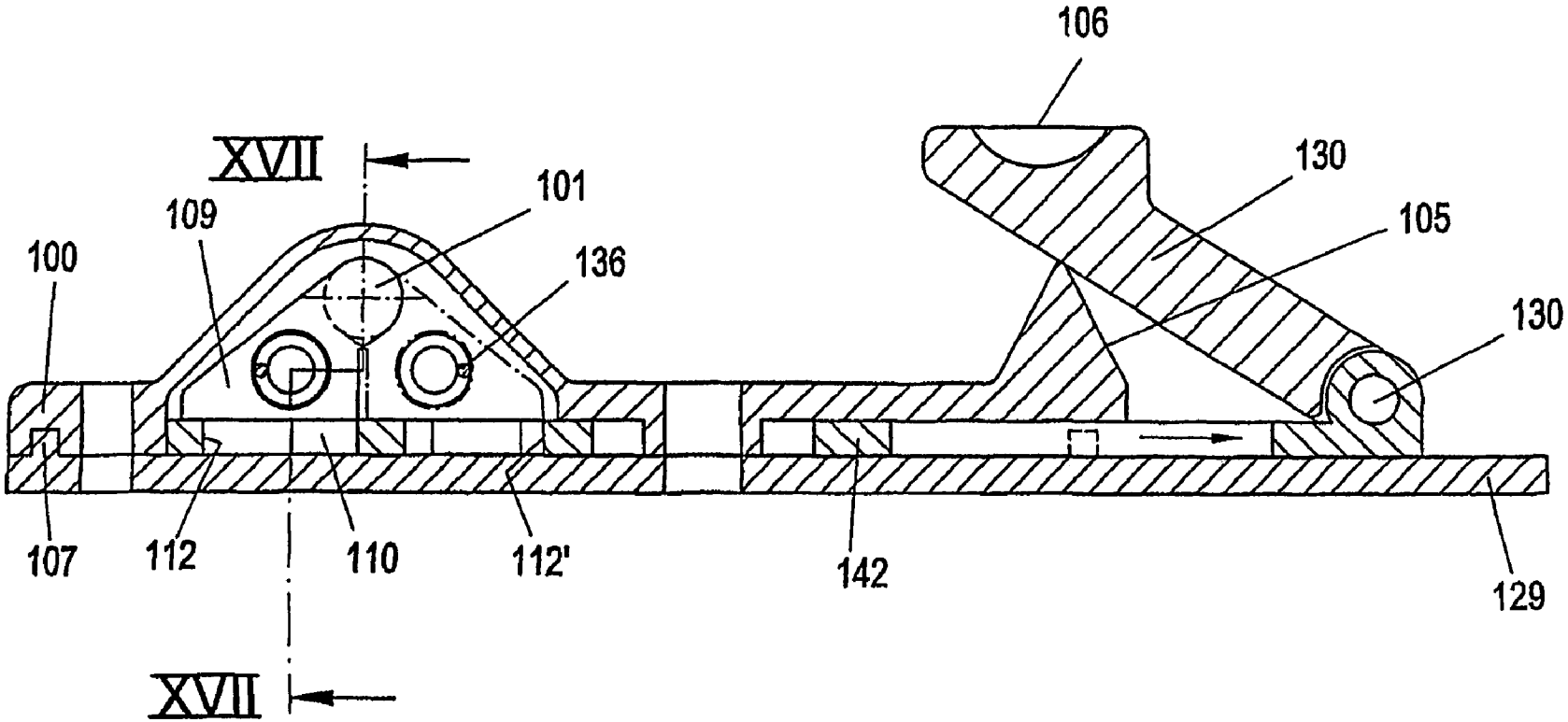
FIG. 16 shows a central longitudinal section of the binding part.
Figure 17:
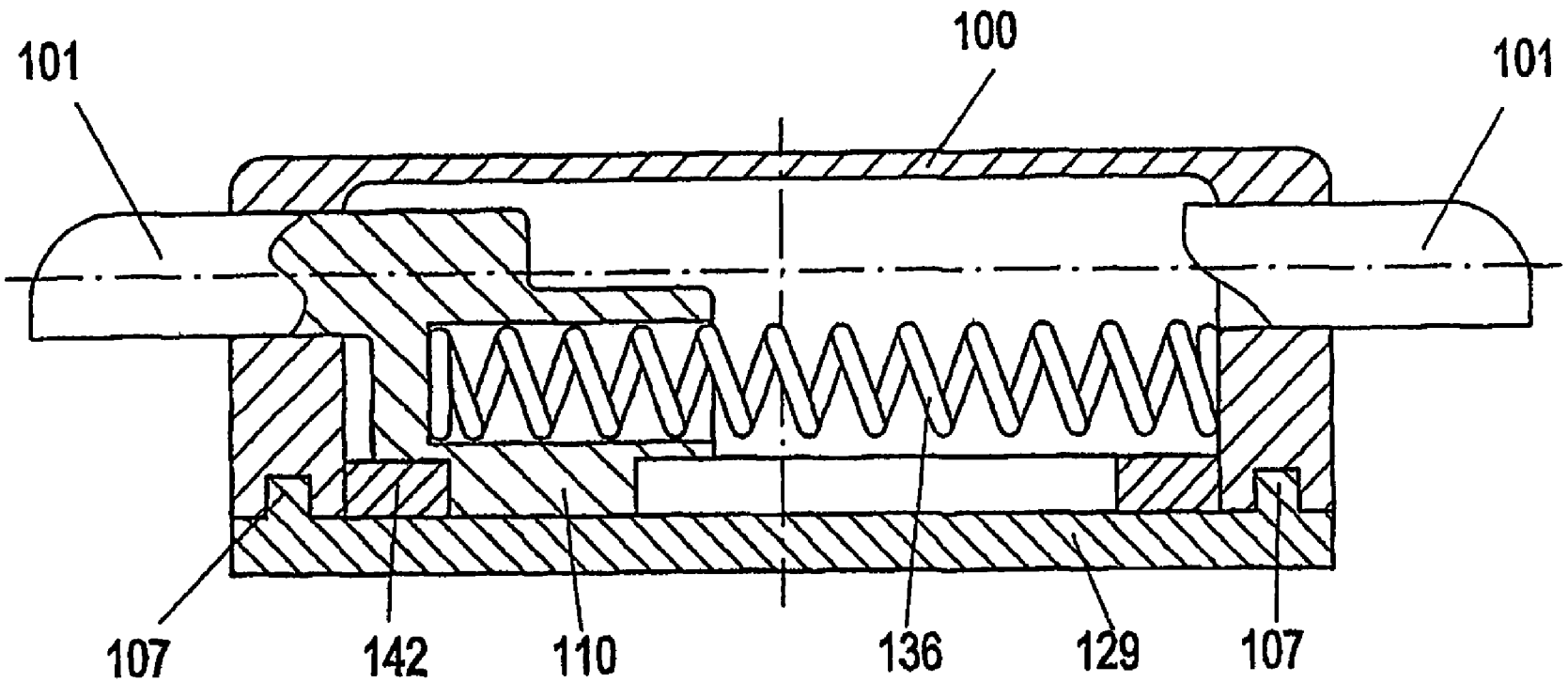
FIG. 17 shows a section according to line XVII—XVII of FIG. 16.

The housing 100 of the cross-country ski binding is seated on a base plate 129 screwed, e.g., to the ski, on which base plate a slide 142 is mounted to be displaceable in the direction of running, as is shown in FIGS. 11 and 12, which slide is connected to a lever 130 projecting obliquely upwards in the running direction via a hinge 130' that extends transversely to the running direction, the lever, as visible in FIG. 14, having an inclined face 105 destined for the step-in and a hollow 106 for inserting the pole therein so as to open the binding.

Figure 10:
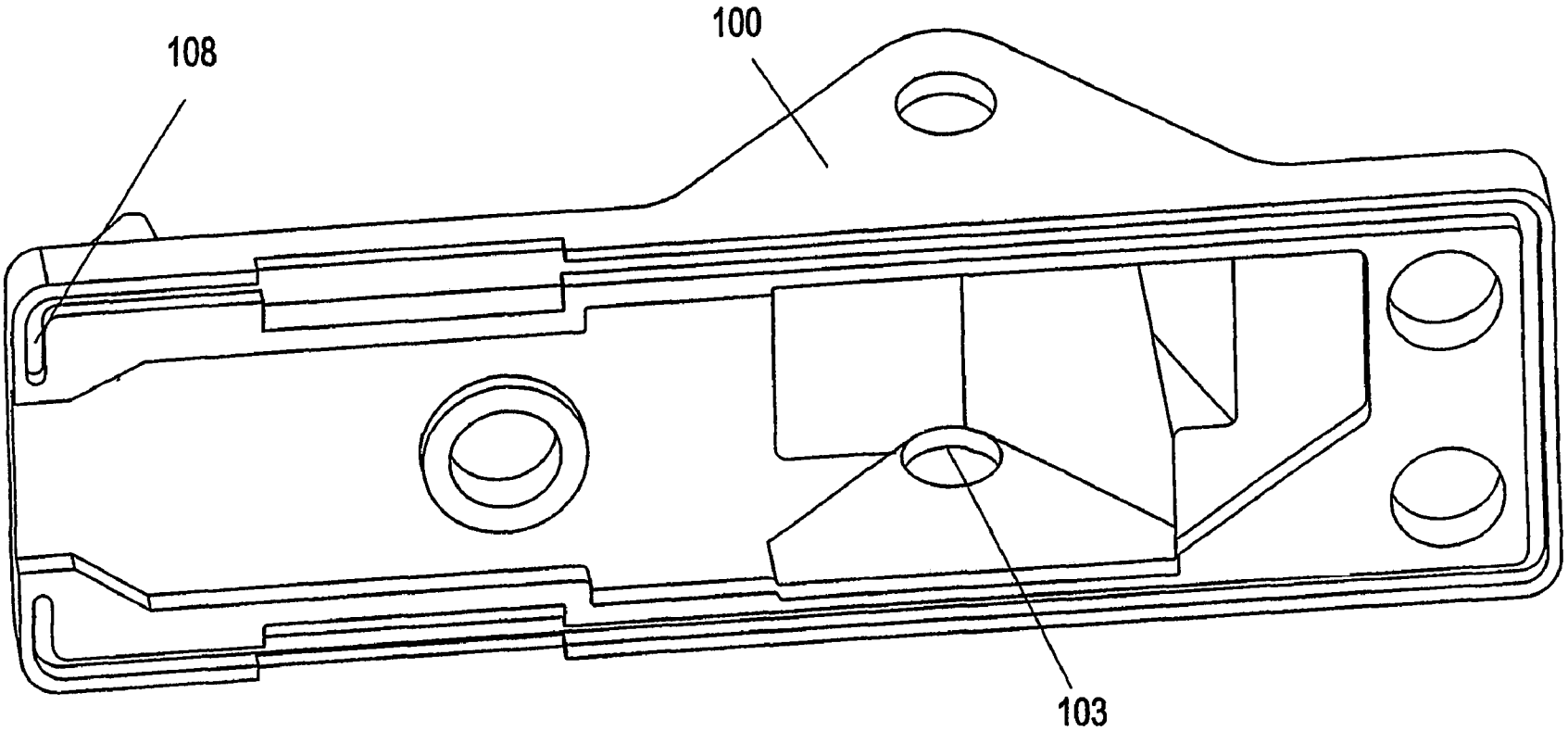
FIG. 10 shows a third embodiment of the cross-country ski binding according to the invention, i.e. a bottom view on the housing of the ski binding.

To prevent snow from penetrating between the base plate 129 and the binding housing 100, the former is provided with a peripheral rib 107 which engages in a corresponding groove 108 of the housing part 100 (FIGS. 10 and 12).

Figure 13:
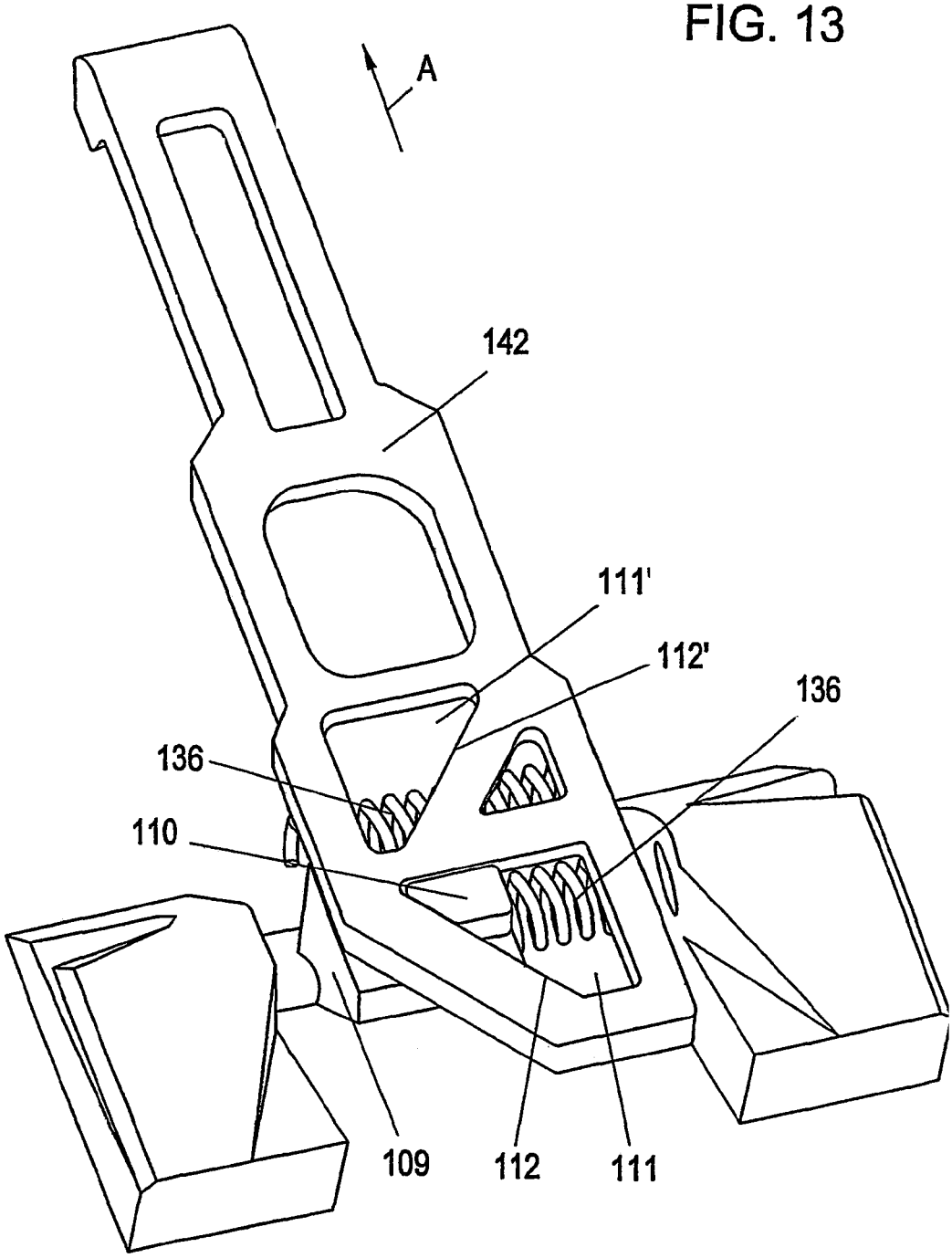
FIG. 13 shows a detail of the opening mechanism.

The bolts 101 project on both sides of the binding from one shaped part 109 each (FIGS. 12, 13 and 15), which shaped parts are located at both sides of the binding in mirror-inverted manner and are provided with a projection 110 which, as shown in FIG. 13, projects into a triangular opening 111 or 111', respectively, of the slide 142. As visible in FIG. 13, the openings 111, 111' are arranged symmetrically opposite each other about an axis extending transversely to the running direction and are each provided with a guiding face 112 or 112', respectively, on which the respective projection 110 of the shaped part 109 is supported, only one of the two projections 110 being shown in FIG. 13 for more clarity.

The shaped parts 109 each are provided with a blind hole 113 so as to accommodate a pressure spring 136 (FIGS. 12 and 15) which are tensioned between the shaped parts 109 and the housing wall of the binding housing 100. Preferably, two pressure springs 136 adjacently arranged in the running direction are provided, as is visible in FIG. 12.

By the mirror-inverted arrangement of the two shaped parts 109 and the possibility of installing two adjacently arranged pressure springs 136, a substantially higher resilience is provided than in common cross-country ski bindings, whereby it is possible to better press out snow that has collected in the corresponding holes of the boot.

The diagonally oppositely arranged projections 110 are supported in the acute-angled corners of the openings 111, 111' of the slide 142 on the inclined guiding faces 112, 112'. When displacing the slide, the projections 109 are pressed towards each other under the influence of the guiding faces 112 and 112' against the force of the springs 136 so as to free the bolts 101 from their snapped-in position.

To step out, the skier presses with the pole on the hollow 106 so that the lever 130 is pivoted downwards. Thereby, the lever 130 slides along the inclined face 105 obliquely towards the lower front side and by this pulls the slide 142 forwards, whereby the two shaped parts 109 are pulled together along the radial cam 112, 112' and the latching pins 101 thus release the boot.

At its front end facing away from the lever 130, the slide 142 is guided in the bridge-part 114 of the housing 100 visible in FIGS. 1 and 5.

In FIG. 12, the fittings of the boot are outlined and denoted by 115.

What is claimed is:

1. A step-in ski binding for cross-country skis and touring skis having a longitudinal axis comprising:

(a) a base plate having a long axis for mounting on a ski coincident with the longitudinal axis thereof;

(b) a housing that projects vertically upward from said base plate;

(c) said housing being narrower transversely than said base plate thereby defining lateral spaces extending from the edges of the base plate to the housing;

(d) two pressure-spring-loaded retention bolts, each having a central axis, mounted in the housing and, in repose, extending substantially transversely to the long axis of the step-in binding and having shaped ends projecting out of said housing on opposite sides thereof toward the edges of said base plate;

(e) the shaped projecting ends of said pressure spring-loaded retention bolts adapted to engage in openings formed in legs of an open bottom, inverted U-shaped portion of a ski boot to thereby lock the retention bolts in the ski boot openings; and (f) a releasing mechanism including a slide mounted on said base plate for relative movement thereto coacting with the retention bolts to force them into the housing removed for the openings of the ski boot so that the ski boot can be lifted vertically upwardly off the housing and freed from the ski binding, wherein coupling members couple the retention bolts with the slide such that actuation of the slide moves the slide relative to the base plate forcing the retention bolts into the housing via the coupling members to release a ski boot from the ski binding, wherein the coupling members are pins that engage with the slide, and wherein the slide defines guides in which the pins are received and guided.

2. A step-in ski binding according to claim 1 wherein the shaped projecting ends of the retention bolts have one of a chamfer, a rounding and an incline formed above their axes.

3. A ski binding according to claim 1, wherein a member defining an inclined surface is mounted on the base plate; and an obliquely upwardly projecting lever, having a hollow for inserting a ski pole therein for actuation, is mounted to the slide, via a hinge; said lever coacting with said member defining an inclined surface for moving the slide relative to the base plate.

4. A step-in ski binding for cross-country skis and touring skis having a longitudinal axis comprising:

(a) a base plate having a long axis for mounting on a ski coincident with the longitudinal axis thereof:

(b) a housing that projects vertically upward from said base plate;

(c) said housing being narrower transversely than said base plate thereby defining lateral spaces extending from the edges of the base plate to the housing;

(d) two pressure-spring-loaded retention bolts, each having a central axis, mounted in the housing and, in repose, extending substantially transversely to the long axis of the step-in binding and having shaped ends projecting out of said housing on opposite sides thereof toward the edges of said base plate;

(e) the shaped projecting ends of said pressure spring-loaded retention bolts adapted to engage in openings formed in legs of an open bottom, inverted U-shaped portion of a ski boot to thereby lock the retention bolts in the ski boot openings; and (f) a releasing mechanism including a slide mounted on said base plate for relative movement thereto coacting with the retention bolts to force them into the housing removed from the openings of the ski boot so that the ski boot can be lifted vertically upwardly off the housing and freed from the ski binding, wherein coupling members couple the retention bolts with the slide such that actuation of the slide moves the slide relative to the base plate forcing the retention bolts into the housing via the coupling members to release a ski boat from the ski binding, wherein the coupling members are shaped parts that engage correspondingly shaped guides in the slide.

5. A ski binding according to claim 4, wherein the ski binding has a seal formed by a peripheral rib defined by the base plate received in a corresponding groove defined by the housing.

6. A combination comprising:

(a) a ski having a longitudinal axis; and (b) a step-in ski binding including (i) a base plate having a long axis mounted on the ski coincident with the longitudinal axis thereof;

(ii) a housing that projects vertically upward from said base plate;

(iii) said housing being narrower transversely than said base plate thereby defining lateral spaces extending from the edges of the base plate to the housing;

(iv) two pressure spring-loaded retention bolts, each having a central axis, mounted in the housing and, in repose, extending substantially transversely to the long axis of the step-in binding and having shaped ends projecting out of said housing on opposite sides thereof toward the edges of said base plate;

(v) the shaped projecting ends of said pressure spring-loaded retention bolts adapted to engage in openings formed in legs of an open bottom, inverted U-shaped portion of a ski boot to thereby lock the retention bolts in the ski boot openings; and (vi) a releasing mechanism including a slide mounted for relative movement with respect to the base plate coacting with the retention bolts to force them into the housing removed from the openings of the ski boot so that the ski boot can be lifted vertically upwardly off the housing and freed from the ski binding, wherein coupling members couple the retention bolts with the slide such that actuation of the slide moves the slide relative to the base plate forcing the retention bolts into the housing via the coupling members to release a ski boat from the ski binding, wherein the coupling members are pins that engage with the slide, and wherein the slide defines guides in which the pins are received and guided.

7. A combination according to claim 6 wherein the shaped projecting ends of the retention bolts have one of a chamfer, a rounding and an incline formed above their axes.

8. A combination according to claim 6, wherein a member defining an inclined surface is mounted on the base plate; and an obliquely upwardly projecting lever, having a hollow for inserting a ski pole therein for actuation, is mounted to the slide, via a hinge; said lever coacting with said member defining an inclined surface for moving the slide relative to the base plate.

9. A combination comprising:

(a) a ski having a longitudinal axis; and (b) a step-in ski binding including (i) a base plate having a long axis mounted on the ski coincident with the longitudinal axis thereof;

(ii) a housing that projects vertically upward from said base plate;

(iii) said housing being narrower transversely than said base plate thereby defining lateral spaces extending from the edges of the base plate to the housing;

(iv) two pressure spring-loaded retention bolts, each having a central axis, mounted in the housing and, in repose, extending substantially transversely to the long axis of the step-in binding and having shaped ends projecting out of said housing on opposite sides thereof toward the edges of said base plate;

(v) the shaped projecting ends of said pressure spring-loaded retention bolts adapted to engage in openings formed in legs of an open bottom, inverted U-shaped portion of a ski boot to thereby lock the retention bolts in the ski boot openings; and (vi) a releasing mechanism including a slide mounted for relative movement with respect to the base plate coacting with the retention bolts to force them into the housing removed from the openings of the ski boot so that the ski boot can be lifted vertically upwardly off the housing and freed from the ski binding, wherein coupling members couple the retention bolts with the slide such that actuation of the slide moves the slide relative to the base plate forcing the retention bolts into the housing via the coupling members to release a ski boot from the ski binding, wherein the coupling members are shaped parts that engage correspondingly shaped guides in the slide.

10. A combination according to claim 9, wherein the ski binding has a seal formed by a peripheral rib defined by the base plate received in a corresponding groove defined by the housing.

* * * * *